US005125321A

United States Patent [19]

Cowan, Jr. et al.

[11] Patent Number: 5,125,321

[45] Date of Patent: Jun. 30, 1992

[54] APPARATUS FOR AND METHOD OF OPERATING A CYLINDRICAL PULSED INDUCTION MASS LAUNCHER

[75] Inventors: Maynard Cowan, Jr.; Billy W. Duggin; Melvin M. Widner, all of Albuquerque, N. Mex.

[73] Assignee: The United States of America as represented by the United States Department of Energy, Washington, D.C.

[21] Appl. No.: 622,897

[22] Filed: Dec. 6, 1990

[51] Int. Cl.[5] ..... F41B 6/00

[52] U.S. Cl. ..... 89/8; 124/3; 318/35

[58] Field of Search ..... 89/8; 124/3; 318/35, 318/135

[56] References Cited

U.S. PATENT DOCUMENTS 2,235,201 3/1941 Cole ..... 89/8

2,870,675 1/1959 Salisburg ..... 89/8

FOREIGN PATENT DOCUMENTS 2829747 1/1980 Fed. Rep. of Germany ..... 124/3

OTHER PUBLICATIONS

M. Driga et al., "Induction Launcher Design Considerations", *IEEE Transactions on Magnetics*, vol. 25, No. 1, Jan. 1989, pp. 153-158.

M. Cowan et al., "Multimegajoule Pulsed Power Generation from a Reusable Compressed Magnetic Field Device", *International Conference On Energy Storage, Compression and Switching*, Asti-Torino, Italy, Nov. 1974, Plenum Press, N.Y., pp. 131-134.

T. Burgess et al., "The Electromagnetic O Gun and Tubular Projectiles", *IEEE Transactions On Magnetics*, vol. MAG-18, No. 1, Jan. 1982, pp. 46-59.

M. Cowan et al., "The Reconnection Gun", *IEEE Transactions On Magnetics*, vol. MAG-22, No. 6, Nov. 1986, pp. 1429-1434.

D. Elliott, "Mesh-Matrix Analysis Method For Electromagnetic Launchers", *IEEE Transactions On Magnetics*, vol. 25, No. 1, Jan. 1989, pp. 164-169.

V. Welsby et al., *The Theory and Design of Inductance Coils*, Second Edition, MacDonald, London, 1960, Chapter 3, pp. 40-68.

R. Plonsey et al., *Principles and Applications of Electromagnetic Fields*, McGraw-Hill, N.Y., 1961, pp. 273-280.

P. Hammond, *Applied Electromagnetism*, Pergamon Press, N.Y., 1985, pp. 189-190.

F. Grover, Inductance Calculations, Dover Publications Inc., N.Y., 1973, Chapter 11, pp. 77-87.

D. Elliott, "Traveling-Wave Induction Launchers", *IEEE Transactions On Magnetics*, vol. 25, No. 1, Jan. 1989, pp. 159-163.

P. Mongeau et al., "ARC-Commutated Launcher", *IEEE Transactions On Magnetics*, vol. MAG-18, No. 1, Jan. 1982, pp. 42-45.

M. Driga et al., "Electromagnetic Induction Launchers", *IEEE Transactions On Magnetics*, vol. MAG-22, No. 6, Nov. 1986, pp. 1453-1458.

Z. Zabar et al., "Design and Power Conditioning For the Coil-Gun", *IEEE Transactions On Magnetics*, vol. 25, No. 1, Jan. 1989, pp. 627-631.

M. Widner, "Overlapped Coils and 3-D Simulations For the Reconnection Launcher", *Fifth ELA Conference*, Auburn, Ala., Sep. 28-30, 1988.

*Primary Examiner*—Stephen C. Bentley

*Attorney, Agent, or Firm*—Karla Ojanen; James H. Chafin; William R. Moser

[57] ABSTRACT

An electromagnetic cylindrical projectile mass launcher and a method of operation is provided which includes a cylindrical projectile having a conducting armature, a cylindrical barrel in which the armature is received, a plurality of electromagnetic drive coil stages, a plurality of pulse energy sources, and a pulsed power arrangement for generating magnetic pulses forming a pulsed magnetic wave along the length of the launcher barrel. The pulsed magnetic wave provides a propelling force on the projectile along the drive coil. The pulsed magnetic wave of the drive coil stages is advanced along the armature faster than the projectile to thereby generate an induced current wave in the armature. The pulsed generation of the magnetic wave minimizes electromagnetic heating of the projectile and provides for smooth acceleration of the projectile through the barrel of the launcher.

19 Claims, 2 Drawing Sheets formation obtained from sychronization unit 20 by the pulse and delay generator 26.

Although each of the elements or circuits of the synchronization unit 20 are of conventional design, it is especially important to note that the delay time, $\tau_d$, between energizing adjacent coils 12 are chosen such that a "slip" is produced between the pulsed magnetic wave and projectile 13 which is of a character to be described.

As the projectile 13 travels within barrel 10 a moving coordinate system is defined such that the y direction is the direction of projectile motion and the origin or y-axis is at the y position of the rear edge of the projectile 13 as shown in FIG. 1.

The duration of the delay time $\tau_d$ is chosen such that, in the reference frame of the projectile, the positions along the y-axis of the projectile at which the coil segments 12 are fired are advanced by an amount $\Delta y = y_{i+1} - y_i$ per coil stage where i = coil stage number, with $$\Delta y = \frac{(v_s/\bar{v})}{(1 - v_s/\bar{v})} d \tag{1}$$

where $v_s$ = a desired slip speed, $\bar{v}$ = average projectile velocity between stage firings, d = length of coil stage, i.e., the center-to-center coil segment spacing, and $y_1 = \lambda/4$, the firing position of the first coil stage 12. The desired wavelength of the inducted armature current is $\lambda$ which will be discussed later. The average projectile velocity can be determined by various conventional techniques such as by measuring the elapsed time between the interruption of adjacent optical beams and dividing it into the intersegment distance, d. Alternatively, two optical beams from laser 20, having a separation in the y direction of a distance f, where f < d, and two photo detectors 24 can be used between coil stages 12 to determine projectile velocity $v_a$, determined by the separation distance f divided by the elapsed time between interruption of the said two optical beams. The velocity $v_a$ is approximately equal to $\bar{v}$ and can be used in place of $\bar{v}$ to operate the launcher. It will be appreciated that the time delay $\tau_d$ decreases by an amount $\Delta\tau_d = \Delta y/\bar{v}$ per coil stage to provide the aforementioned advance in firing position.

Alternative methods for sensing projectile position can be considered, such as a laser interferometer, mechanical contact, electric sensing, or radio frequency sensing circuits. Preselecting the delay timing is also possible but requires precise knowledge of launcher performance before the launch.

Thus drive coil stages 12 are fired sequentially with respective time delays, $\tau_d$, between firings calculated such that a induced current wave is produced in the armature 14 of projectile 13. The induced current wave is spatially restricted at any given time within or on the surface of armature 14 and moves with velocity $v_s$ along the armature 14 in the direction of motion of projectile 13 and with a wavelength $\lambda$. A plot of the current profile of the travelling surface wave is shown in FIG. 2 as produced by exemplary adjacent coil stages 12 at positions or locations corresponding to positions $y_i$ and $y_{i+1}$. As shown in FIG. 2, the current profile is the same for both segments and is merely translated forward along the y-axis by an amount $y_{i+1} - y_i$. The effect of the induced current wave, as described above, is to minimize the amount of ohmic heating of the armature. This is accomplished by the slow change in the applied magnetic wave and in the induced current wave that results in deep penetration and spreading of the current in the armature 14. The armature current density is therefore low, and, because ohmic heating depends upon current density squared, the ohmic heating is low.

Preferably, the wavelength $\lambda$ of the induced armature current is maintained constant throughout the acceleration of projectile 13. This is achieved by selecting the pulse rise time $\tau_R$ of the pulse applied to the coil stage 12 to be $$\tau_R = \frac{\lambda}{4\bar{v}_R} \tag{2}$$

where $\bar{V}_R$ = average velocity during the pulse rise time. Note that the velocity increases during acceleration, therefore to maintain a constant wavelength, the rise time $\tau_R$ decreases from stage to stage during the launch process. A desired pulse rise time $\tau_R$ of a given coil stage can be obtained by choosing the appropriate coil stage inductance and capacitance of pulsed energy source 18 for that stage.

In addition, the pulsed magnetic wave preferably is maintained at a constant magnitude, a feature that can be regulated by the amount of energy chosen for the respective units of the pulsed energy source 18. However, some variability in $\lambda$ or the magnitude of the pulsed magnetic wave may be appropriate for certain applications.

To start the projectile 13 from zero velocity, it is required that the projectile 13 be injected at a low velocity or alternatively positioned with the rear edge of the projectile 13 within or just beyond the first coil stage 12. The projectile 13 can be spun prior to injection into the barrel 10. Several coil stages will be fired and operated in the start up phase of operation before the induced armature current wave will achieve the conditions desired as previously described and as shown in FIG. 2 (the desired phase of operation). The initial fire position of the first coil stage will be at a position approximately $\lambda/4$ forward from the rear edge of the projectile, i.e., at $y_1 = \lambda/4$. The firing positions are then advanced from stage to stage by an amount $\Delta y$ as given in Equation 1. The time required for the said start-up phase to develop into the said desired phase is the time for the magnetic wave to diffuse into the armature 14.

The firing position and the leading edge of the induced current wave can advance to the forward end of projectile 13 depending upon the length of projectile 13 along the y-axis, the slip speed $v_s$, and the duration of acceleration. Under such circumstances, subsequent firing times are synchronized, by proper choice of the time period $\tau_d$, such that pulses are again applied to the aft of projectile 13 to thereby produce a new pulsed magnetic wave which starts from the aft end of projectile 13. This is referred to as restarting. Of course, by a suitable choice of firing times, a new induced current wave can be generated at any location along the length of projectile 13 to accomplish this restarting. Preferably, the firing position is reset by a distance equal to an integral number of wavelengths or a fraction of a wavelength. In any case, the firing times of the pulses are preferably synchronized such that no pulses are applied beyond the leading or forward surface of projectile 13. The direction of the applied magnetic wave can be in the opposite direction for the restarted magnetic wave. The restart process can also be repeated several times.

It will be appreciated from the foregoing that an induced current wave of arbitrary velocity $v_s$ and wavelength $\lambda$ can be generated in the armature 14. Since, as discussed above, the amount of ohmic heating of a projectile is generally proportional to the frequency of the induced current wave in the armature, armature heating is minimized by choosing firing times such that a induced current wave of low but non-zero frequency is generated. Therefore, greater projectile velocity can be achieved, as compared to the prior art, for the same amount of ohmic heating.

An additional advantage of the invention, achieved by synchronizing the firing times of pulses such that no pulses are applied beyond the forward surface of projectile 13, is that no retarding force is applied to the front of the projectile 13 to hinder acceleration. Further, a payload 16, located forward of the front armature surface will not be subjected to any strong, and possibly damaging, magnetic fields.

With the requirements of equations (1) and (2) satisfied, experiments and detailed numerical simulations have verified that a pulsed magnetic wave such as described above can be established to good approximation; however, fluctuations in acceleration corresponding to projectile transit between successive coil stages have been observed. Such fluctuations are small provided that $\lambda/4>d$ and even smaller fluctuations if $\lambda/4>>d$ and therefore can be controlled by selection of the length of the stage d and the wavelength $\lambda$.

Because the projectile must be designed to mechanically withstand the peak launch acceleration, and because the launcher length depends upon the average launch acceleration, then the minimum launcher length is obtained when the peak acceleration is equal to the average acceleration. With the launcher operated as previously described the peak acceleration nearly equals the average acceleration and the described launcher has the above advantages.

Table I shows launcher parameters for an exemplary, non-limiting, embodiment. It is noted that the present invention can be applied to planar launchers such as those disclosed in M. Cowan et al, *IEEE Tran. Magn.* MAG-22, 1429 (1986).

Although the invention has been described with respect to exemplary embodiments thereof, it will be understood by those skilled in the art that variations and modifications can be effected in these exemplary embodiments without departing from the scope and spirit of the invention.

TABLE I

| | | |
|---|---|---|
| PROJECTILE | | |
| Projectile mass | 450 | kg |
| Payload mass | 400 | kg |
| Armature composition | 7075-T73 | Al |
| Projectile outer diameter | .497 | m |
| Projectile length | 1.49 | m |
| Initial armature temperature | −196 | C. |
| LAUNCHER SEGMENT (MULTI-TURN COIL) | | |
| Inner diameter | .540 | m |
| Length | .180 | m |
| Number of turns | 8 | |
| Composition | | Al |
| Inductance (without projectile) | 44.5 | microhenry |
| LAUNCHER | | |
| Stage separation | .200 | m |
| Total number of stages | 3100 | |
| Total length | 620 | m |
| Stored energy/segment | 5 | MJ |
| Maximum voltage | 182 | kV |

TABLE I-continued

| | | |
|---|---|---|
| Peak coil current | 395 | kA |
| Pulse rise length | 0.4 | m |
| Slip velocity ($V_s$) | 2 | m/s |
| PERFORMANCE | | |
| Final velocity | 4149 | m/s |
| Efficiency (kinetic energy/stored energy) | 47.2% | |
| Average acceleration | 1.42 | kgees |
| Peak/average acceleration | 1.05 | |
| Maximum armature temperature | 19 | C. |
| Armature ohmic/kinetic energy | 0.00146 | |

We claim:

1. An electromagnetic cylindrical projectile launcher comprising:

(a) a cylindrical projectile having a front end and an aft end, further comprising a cylindrical conducting armature;

(b) a cylindrical barrel extending in length concentric with said projectile to receive said projectile;

(c) a plurality of toroidal electromagnetic drive coil stages concentric with said barrel, spaced along the length of said barrel, each of said coil stages in turn inductively coupled to said armature, said drive coil stages sequentially and individually energized by its corresponding energy source by means for firing and switching said pulsed energy source in response to means for sensing the location of said projectile within said barrel;

(d) a plurality of pulsed energy sources, each of said energy sources in a one-to-one relationship with each of said coil stages, to provide in sequential numerical order energy pulses to said coil stages, thereby generating a sequence of magnetic pulses which combine to form a pulsed magnetic wave advancing along the length of said barrel, said magnetic wave having a velocity greater than said projectile and inducing a current wave within said armature, said current wave having radial and axial force components resulting in acceleration of said projectile through said barrel;

wherein said pulsed energy sources sequentially energizes its corresponding coil stage in response to means for synchronizing said magnetic pulses with respect to the location of said projectile such that said armature current wave advances from an aft end of said armature towards a forward end of said armature.

2. The launcher of claim 1, wherein said means for sensing the location of said projectile comprises:

(a) means for projecting a plurality of optical beams across a chord along a barrel cross-section so that as said projectile advances through the length of said barrel, said projectile sequentially interrupts said optical beams; and (b) means for sensing said interruption of said optical beams.

3. The launcher of claim 2, wherein each of said coil stage generates a magnetic pulse when said projectile is accelerated along the length of said barrel such that the position of said projectile with respect to the coil stage being fired in the projectile frame of reference is advanced by an amount $\Delta y$ per coil stage, where $$\Delta y = \frac{(v_s/\bar{v})}{(1 - v_s/\bar{v})}\, d.$$

APPARATUS FOR AND METHOD OF OPERATING A CYLINDRICAL PULSED INDUCTION MASS LAUNCHER

The U.S. Government has rights in this invention pursuant to Contract No. DE-AC04-76DP00789 awarded by the U.S. Department of Energy to American Telephone & Telegraph Company.

FIELD OF THE INVENTION

The invention relates to a pulsed-induction electromagnetic mass launcher and method of operation.

BACKGROUND OF THE INVENTION

Numerous electromagnetic mass launchers have been developed for accelerating a projectile to high velocity. In a typical prior art electromagnetic launcher, a travelling magnetic wave is generated along a cylindrical barrel while an electric current is simultaneously generated on the surface of or within the armature. As the magnetic wave propagates along the barrel, rail or track, the force resulting from the electromagnetic pulse and the induced armature current accelerates the projectile. To energize the armature of the projectile, current is initially generated in the launcher, and then induced in the armature. In contrast, in some of the earliest launchers, current was conducted to the armature by means of sliding contacts connecting a portion of the launcher to the armature. And yet in other launchers, current was conducted to the armature by means of electromagnetic arcing between launcher and the armature.

Recently, launchers have been devised and operated using induction rather than sliding contacts or arcs to produce the electric current in the armature of the projectile. More particularly, two basic types of such induction launchers have been developed.

In the first type of induction launcher, called a "pulsed-induction" launcher, magnetic field pulses are sequentially generated by successive barrel coils with the pulses being synchronized with the aft portion of the projectile such that currents are induced on the aft surface of the projectile. An increase of acceleration is achieved by increasing the magnetic field strength of the applied magnetic pulses. However, the current induced on the aft surface of the projectile decays because of the resistive nature of the armature and the magnetic field then penetrates forward. This penetration severely degrades the efficient transfer of energy from the coils to the projectile and reduces acceleration. To overcome the performance loss, the direction of the applied magnetic field can be reversed from stage to stage. However, this leads to concentration of current on the armature surface and significant ohmic heating and armature ablation. The temporal acceleration pulse is also highly peaked and choppy. Because the launcher length is determined by average acceleration and the projectile design is dependent upon the peak acceleration, an excessive launcher length is required for a given projectile design.

In the second type of induction launcher, a sinusoidal magnetic field is generated within the barrel. Sinusoidal travelling wave launchers do not use pulsed induction methods; rather, currents in the barrel drive coils are sinusoidally oscillated according to a phased time sequence and with the frequency of oscillation increasing as the speed of the projectile increases. An increase of acceleration is achieved by increasing the strength of the sinusoid applied magnetic field. The sinusoidal magnetic field is timed to travel slightly faster than the projectile such that, as the projectile lags the applied magnetic field, the surface of the projectile experiences a time rate of change in magnetic field which induces a current on that surface. The difference in speed between the travelling magnetic wave and the projectile is commonly referred to as the "slip speed".

In the sinusoidal continuous wave launchers, the current penetrates the armature more deeply, thus, ohmic heating is reduced in the armature. However, the barrel coils are energized for long periods of time leading to coil heating and inefficient operation because energy dissipated by ohmic heating cannot be transferred to the projectile. Moreover, current concentration at the front and rear of a projectile increase armature heating in those regions and, in the front of the armature, cause a retarding force.

It is thus an object of the invention to minimize ohmic heating in the armature of a cylindrical launcher. The feature of the inventive method that achieves this object is to select firing times of the coils so that the induced current wave in the armature has a low but non-zero frequency.

It is a further object of the invention to provide for smooth acceleration of the projectile through the launcher. One feature of the inventive method that achieves this result is the synchronization of firing the magnetic pulses from the coil stages so that no pulses are applied beyond the forward surface of the projectile to generate any retarding forces. Another is the relatively long length of the armature compared to the coil.

It is a further object of the invention to provide for minimal damage to the payload. In achieving the smooth acceleration as stated above, no forces are applied to the front of the projectile, so that a payload positioned on the front end of the projectile does not experience damaging forces, heating, and induced currents and voltages in payload electronic components.

It is yet another object of the invention to further maximize performance. The invention achieves this object by minimizing ohmic heating in the coils and in the armature.

These and other objects of the invention will become apparent upon a reading of the summary and the detailed description of the invention.

SUMMARY OF THE INVENTION

In accordance with one aspect of the invention, an electromagnetic projectile launcher is provided which comprises: a conducting projectile, a barrel that receives the projectile, a plurality of electromagnetic drive coils, a plurality of pulsed energy sources, and pulse power means for generating a sequence of pulses forming a pulsed magnetic wave within the drive coil for propelling the projectile along the barrel, wherein the pulsed magnetic wave of the drive coil is advanced along the barrel faster than the projectile to thereby induce a current wave in the armature of the projectile and thereby minimize electromagnetic heating of the projectile and provide nearly constant acceleration of the projectile.

In accordance with another aspect of the invention, a method is provided for propelling a projectile within a pulsed induction electromagnetic coil launcher, wherein the method comprises the steps of: generating a sequence of pulses forming a pulsed magnetic wave within the coil launcher, applying the pulsed magnetic wave initially at the aft end of the projectile to accelerate the projectile within the coil launcher, and advancing the position of the pulsed magnetic wave relative to the projectile to thereby generate an induced current wave in the armature, such that electromagnetic heating of the projectile is minimized and acceleration is nearly constant.

As noted above, the amount of electromagnetic heating of the armature in an electromagnetic launcher varies with the density of the induced current which increases with frequency. Thus by applying a pulsed magnetic wave that changes slowly in time in the projectile reference frame to the projectile using pulsed coil stages, the armature heating caused by high current densities is minimized without incurring the performance disadvantages inherent in the non-pulsed launchers. Therefore, a launcher constructed in accordance with the invention can achieve higher speeds than prior art methods without damaging the projectile or payload. Also, because the pulsed magnetic wave and the induced current wave change slowly with time, the force changes slowly with time and the acceleration can be nearly constant along the launcher.

The invention also has further advantages. For example, because the applied pulses are confined to the projectile, there is no retarding force on the front of the projectile, and there is no direct exposure of a frontal payload to strong magnetic pulses.

Other features and advantages of the invention will be set forth in, or be apparent from, the detailed description of the preferred embodiments which follows.

DETAILED DESCRIPTION OF THE PREFERRED EMBODIMENT

Figure 1:
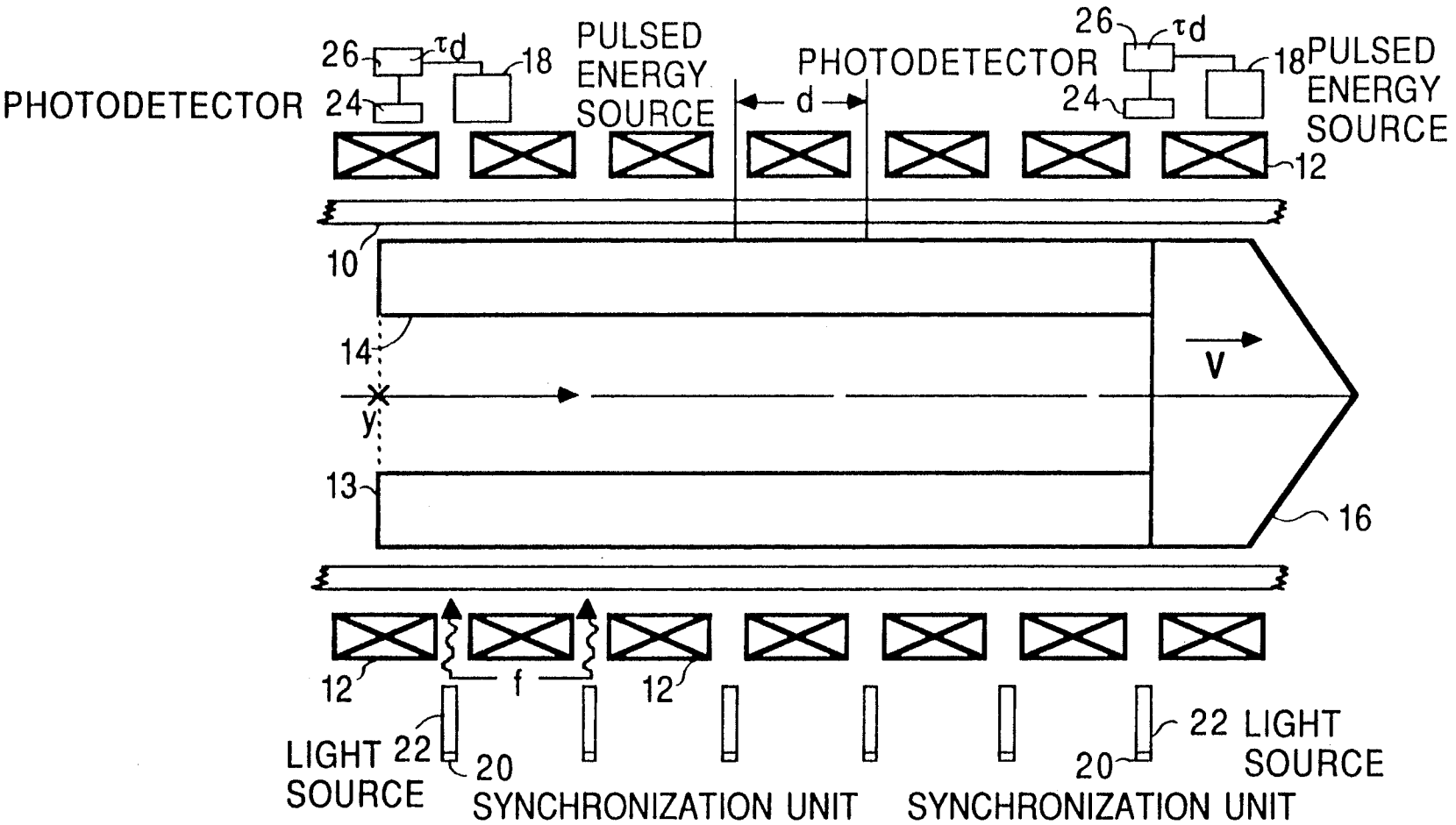
FIG. 1 shows a side cross-sectional view of a portion of a pulsed-induction electromagnetic launcher constructed in accordance with a preferred embodiment of the invention.
Figure 2:
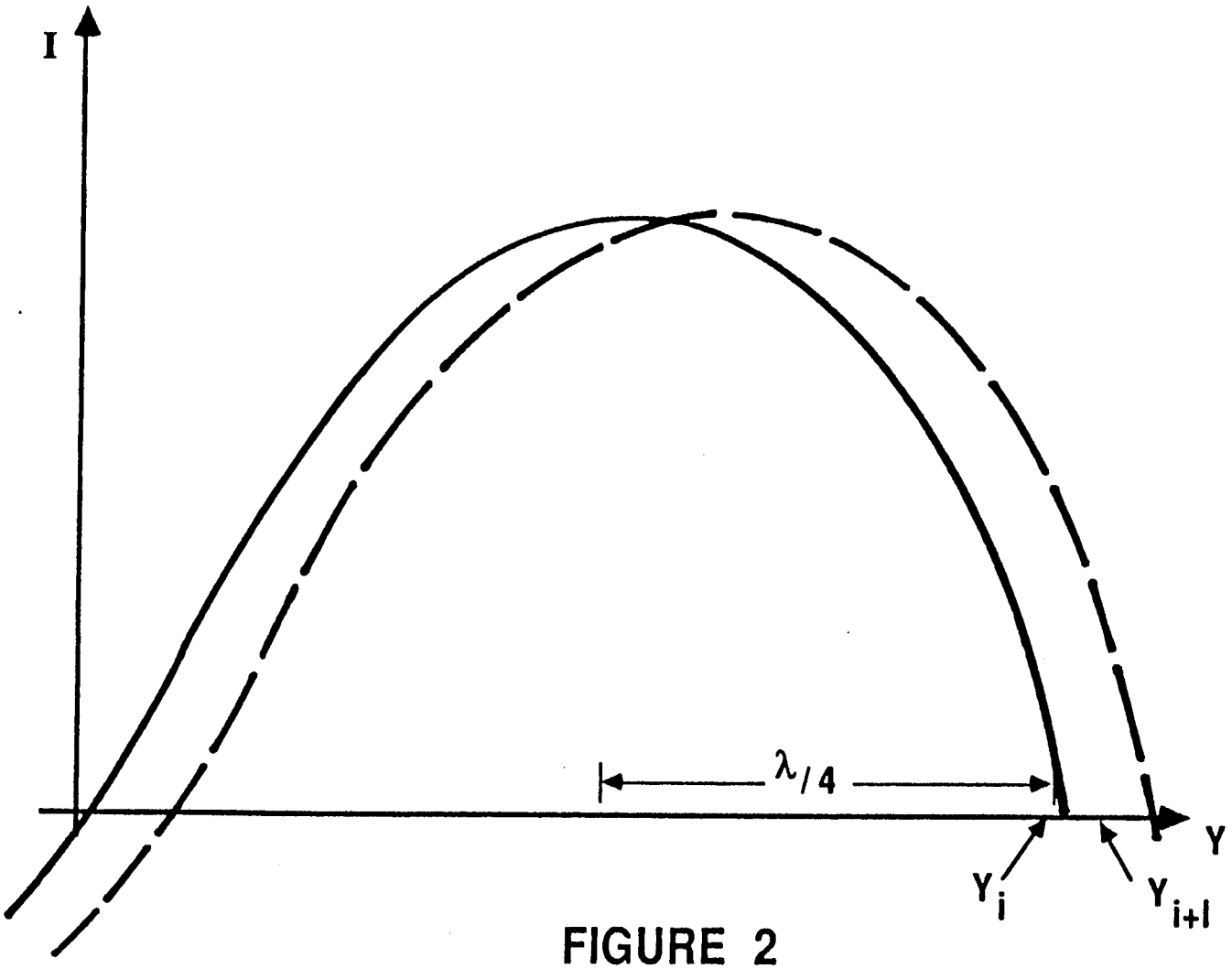
FIG. 2 is a graph showing the induced armature current distribution along the length of the armature of the embodiment of FIG. 1.

Referring to FIG. 1, a preferred embodiment of the invention will now be described. The pulsed-induction electromagnetic launcher is shown in FIG. 1 and comprises a cylindrical barrel 10 and a plurality of individual electromagnetic coil stages 12, each of a generally toroidal shape, which may have a variable number of turns.

A cylindrical projectile 13, is received within barrel 10. Projectile 13 has to have an armature 14 and may or may not have a payload 16. Barrel 10 must not significantly interfere with the magnetic wave generated by the coil stages 12. The armature 14 can be cooled prior to launch to reduce electrical resistivity and improve performance. In general, armature 14 can incorporate a payload 16, shown in FIG. 1 at the front of the armature 14, but payload 16 can be embodied into armature 14 in a number of ways e.g., payload 16 can be positioned and supported within the hollow interior of armature 14. Armature 14 is constructed of a material that is a good electrical conductor, is mechanically strong, has a low mass density, and maintains high strength at high temperature. Solid conducting metals such as certain Al alloys have proven useful. The length of armature 14 is substantially greater than the length of a coil stage 12. And payload 16 must have sufficient mechanical strength to withstand the acceleration.

The barrel 10 must not significantly interfere with the magnetic coupling between the coil stages 12 and the armature 14. The barrel 10 must guide the projectile 13 during the launch process. High mechanical strength insulator materials such as composite plastics, have proven useful as material for barrel 10. Alternatively metallic barrels could be considered provided the metal is very resistive or is not continuous in the azimuthal direction thereby preventing significant eddy currents in the barrel 10 in the azimuthal direction.

The individual coil stages 12 are sequentially pulsed by a plurality of pulsed energy sources 18 (two of which are shown in FIG. 1) to produce a sequence of magnetic pulses that form a pulsed magnetic wave which advances along the launcher in the direction of projectile motion FIG. 1. Any of a number of various conventional pulse power techniques can be used energize, or "fire", coil stages 12. For example, a plurality of capacitor banks (not shown) can be separately discharged with separate closing switches, such as an ignitron, to provide pulsed energy to corresponding coil stages 12. Each closing switch is fired by a firing pulse from the pulse and delay generator 26 in response to a signal from the photodetector 24. The pulse and delay generator 26 also contains signal processing and computing circuitry. The choice of coil inductance L and pulsed energy source capacitance C can be used to provide the proper pulse rise time, $\tau_R$, and pulse shape which is discussed below. A crowbar circuit can also be employed to modify the pulse shape to maximize performance.

The spacing between the coil stages 12 should be minimized, and the spatial requirements are dictated by mechanical and synchronization means. The radial spacing between coil stages 12 and armature 14 should also be minimized, and these spatial requirements are dictated by both mechanical support, in part provided by barrel 10, and electromagnetic field considerations to maximize the inductive coupling between the coil stage 12 and the armature 14.

The pulsed magnetic wave is applied to projectile 13 such that an electric current is induced within armature 14. Forces between the pulsed magnetic wave and the induced armature current accelerates projectile 13 along barrel 10 in the direction of arrow y. The magnetic wave is synchronized with the location of induced current in the armature 14 of projectile 13 such that the wave travels slightly faster than projectile 13 and therefore produces a net "slip" relative to projectile 13.

Synchronization is accomplished by plurality of synchronization units, generally denoted 20, each located between corresponding coil segments 12. Although the figure shows an optical timing and synchronization unit, any other method may be used. Each synchronization unit 20 includes a laser 22, or other optical beam generator, which projects an optical beam perpendicular to, and directly across the path of, projectile 13. A photodetector 24 is provided for each laser 22 to receive the optical beam and detect an interruption in the beam caused by the passing of projectile 13. A signal is output from photodetector 24 to a pulse and delay generator 26 which triggers the firing of a corresponding pulsed energy source 18 for a drive coil 12 after a time interval $\tau_d$. The delay time $\tau_d$ is computed between coil stage firings from sensed projectile position and velocity in- and where $v_s$ = the speed of said armature current wave in the reference frame of said armature, and $\bar{v}$ = the average speed of said projectile in the reference frame of said coil stage and d is the length of said coil stage.

4. The launcher of claim 3, wherein the time that each of said coil stages generates a magnetic pulse is synchronized with the location of said projectile so that, if said current wave advances to the forward end of said projectile, a new magnetic wave is generated at the aft end of said projectile.

5. The launcher of claim 3, wherein the time that each of said coil stages generates a magnetic pulse is synchronized with the location of said projectile so that, if said current wave advances to the forward end of said projectile, a new magnetic wave is generated between the aft end and front end of said projectile.

6. The launcher of claim 1, wherein said pulsed energy sources further comprises means for applying energy pulses to its corresponding coil stage, said energy pulse having a rise time, $\tau_R$, where $\tau_R = \lambda/(4v_R)$, $\lambda$ is the wavelength of said current wave in said armature, and $v_R$ is the average speed of said projectile in the reference frame of said launcher during said pulse rise time such that $\lambda$ is held constant as a function of time.

7. The launcher of claim 3, wherein said coil stage length d and the wavelength of said current wave $\lambda$ are chosen such that $\lambda/4 > d$ and $\lambda/4$ is less than the length of said armature.

8. An electromagnetic launcher as in claim 1, wherein said projectile is spinning when injected into said barrel.

9. A method of propelling a cylindrical projectile with a front end and an aft end and further having an armature along a cylindrical pulsed induction electromagnetic coil launcher having a plurality of sequential coil stages, said method comprising the steps of:

(a) sequentially generating within said coil stages, wherein each stage has a selected and unique capacitance and inductance, a plurality of magnetic pulses having the same direction, wherein the pulses combine to form a pulsed magnetic wave with a constant wavelength within said cylindrical coil launcher, the capacitance and inductance of each of the coil stages selected so that the rise time of the magnetic pulse decreases as the velocity of said cylindrical projectile increases to maintain the constant wavelength of said pulsed magnetic wave;

(b) applying said pulsed magnetic wave with a constant wavelength to the cylindrical projectile armature to accelerate said projectile within said cylindrical coil launcher; and (c) causing the position of said pulsed magnetic wave with constant wavelength to advance relative to an aftend of said armature thereby inducing a current wave with a constant wavelength within the cylindrical armature.

10. The method of claim 9, wherein said step of sequentially generating magnetic pulses comprises sensing the location of the projectile within the coil launcher, and generating a magnetic pulse synchronous with the location of the induced current in the armature of the projectile.

11. The method of claim 9, wherein said step of sensing the location of the projectile within the coil launcher comprises projecting a plurality of optical beams across the path of the projectile such that the projectile sequentially interrupts the beams during travel thereof along the launcher, and sensing interruption of the projected beams caused by the projectile.

12. The method of claim 9, further comprising the step of reapplying said pulsed magnetic wave to the aft end of the projectile if the current wave advances beyond the forward end of said armature to thereby generate a new advancing current wave.

13. The method of claim 9, further comprising the step of reapplying said pulsed magnetic wave to an intermediate position between the aft end and the front end of the projectile if the current wave advances beyond the forward end of said armature to thereby generate a new advancing current wave.

14. The method of claim 9, wherein said step of advancing the position of said pulsed magnetic wave relative to the projectile comprises advancing the position at which the next pulse in sequence is applied by an amount $\Delta y$ in the projectile frame of reference, where $$\Delta y = \frac{(v_s/\bar{v})}{(1 - v_s/\bar{v})} d, \text{ and}$$

where $v_s$ = the speed of said surface wave in the reference frame of the projectile, $\bar{v}$ = the average speed of the projectile, in the reference frame of the coil launcher, measured between application of pulses and d is the spacing between the coil segments.

15. The method of claim 9, wherein the wavelength, $\lambda$, of the current wave in the armature remains constant with time.

16. The method of claim 15, wherein the constant wavelength is provided by applying pulses to the coil stages which have a rise time, $\tau_R$, where $$\tau_R = \lambda/(4v_R),$$

and $v_R$ is the average speed of said projectile in the reference frame of the launcher during said pulse rise time.

17. The method of claim 15, wherein the coil stage length d and the wavelength of the current wave $\lambda$ are chosen such that $\lambda/4 > d$ and $\lambda/4$ is less than the length of the armature.

18. The launcher of claim 16, wherein the magnitude of the pulsed magnetic wave of the drive coil stages remains remain constant with time.

19. The method of claim 9 wherein the projectile is spinning when injected into said barrel.

* * * * *